United States Patent [19]

Beach

[11] 4,073,067

[45] Feb. 14, 1978

[54] POCKET-SIZE ELECTRONIC DEVICE FOR PLAYING CHESS

[76] Inventor: Bruce M. Beach, Hornings Mills, Canada

[21] Appl. No.: 795,177

[22] Filed: May 9, 1977

[51] Int. Cl.[2] ..... A63F 3/00; G09B 1/00

[52] U.S. Cl. ..... 35/8 R; 340/323 R; 364/410; 273/237

[58] Field of Search ..... 235/92 GA, 152, 156; 273/1 E, 85 R, 136 A, 137, DIG. 28; 35/6, 8 R, 9 B; 340/323 B, 323 R; 364/200, 900

[56] References Cited

U.S. PATENT DOCUMENTS

| | | | |
|---|---|---|---|
| 3,395,463 | 8/1968 | Worden et al. | 273/136 A |
| 3,863,928 | 2/1975 | Nelson | 35/8 R |
| 3,888,491 | 6/1975 | Bernard et al. | 273/136 A |
| 4,019,745 | 4/1977 | Mustelier | 273/136 A |

OTHER PUBLICATIONS

"Chess Mate" — Electronics; Mar. 4, 1976; p. 44.

"Chess and Chance Games Win at Electronics Show;" Electronic Design; Newscope — p. 21 — Feb. 15, 1977.

*Primary Examiner*—Malcolm A. Morrison
*Assistant Examiner*—Errol A. Krass

[57] ABSTRACT

A pocket-size portable electronic device for playing chess problems comprises an electronic visual display, a display driver, an 8-digit keyboard and scanner, function keys and scanner, a random access memory, registers and counters, and a logic control unit which includes a switchable data bus controlled by a read only memory, a ROM pointer and a clock. The logic control unit decodes entered coded groups of data according to a special decoding algorithm, the decoded groups represent white and black moves for solving a chess problem. The groups are stored in a random access memory in use. The device responds to specific white moves input. If the input white move is the same as the stored corresponding white move, the device will display the next black move. The user then decides upon his next white move, the play is continued until the problem is solved by the entry of correct white moves.

2 Claims, 7 Drawing Figures

FIG.2.
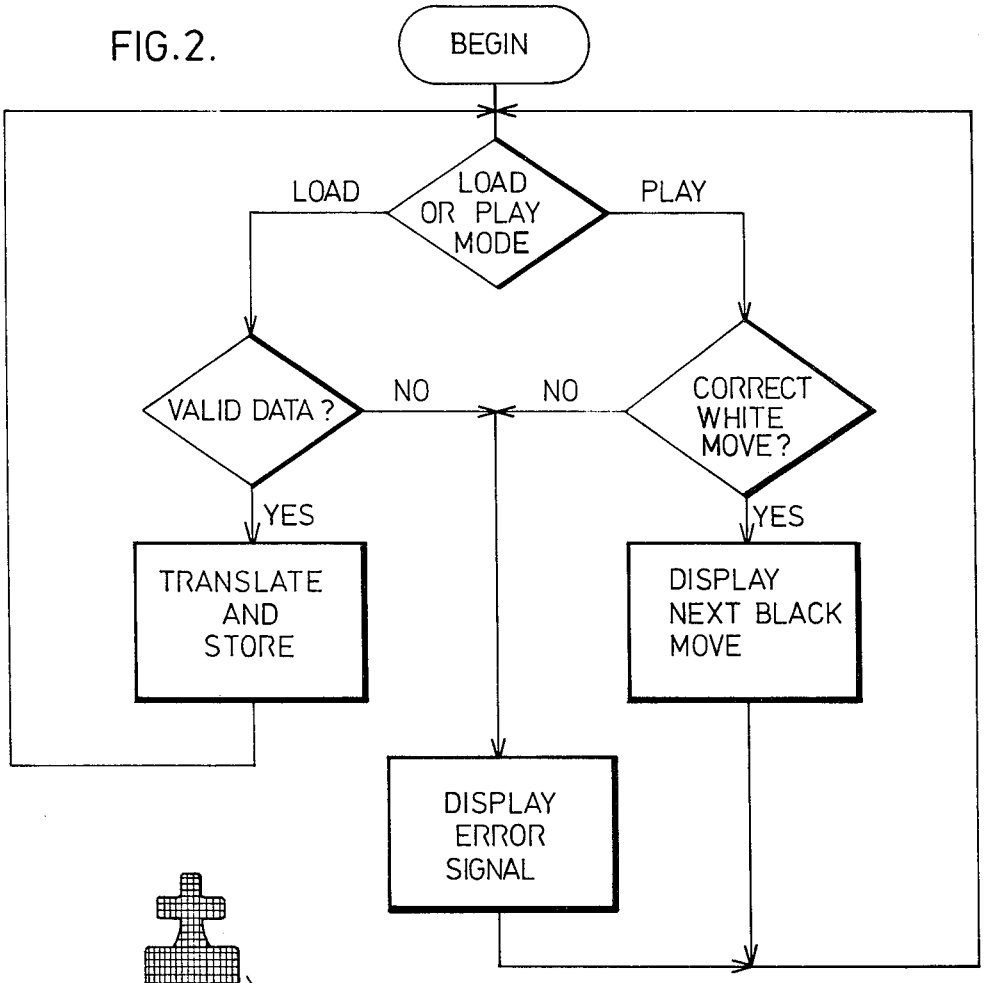
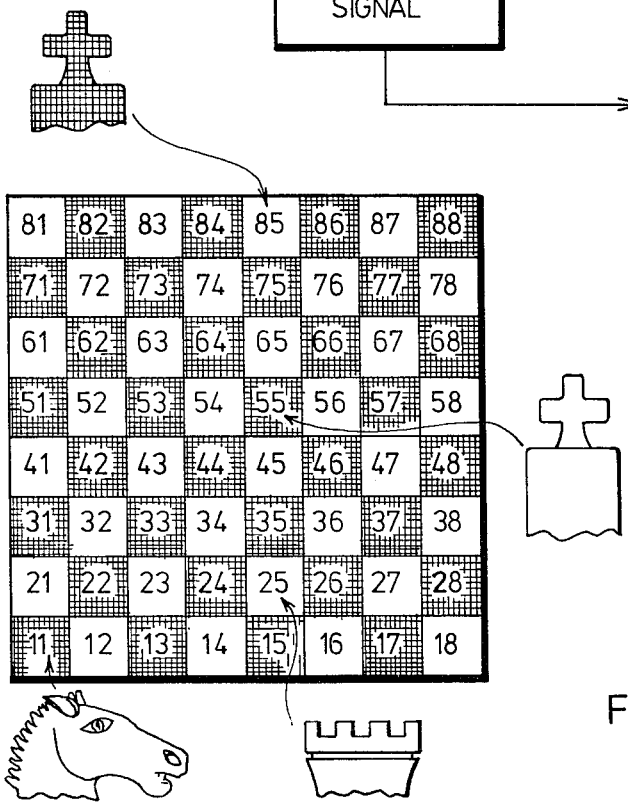
PROBLEM CODE
2222
3258
6163
7486
4181
2344
1261
4382
6781
5655
8171
FIG.5.

| POSITION | 1 | 2 | 3 | 4 | 5 | 6 | 7 | 8 | 1 | 2 | 3 | 4 | 5 | 6 | 7 | 8 | 1 | 2 | 3 | 4 | 5 | 6 | 7 | 8 | 1 | 2 | 3 | 4 | 5 | 6 | 7 | 8 | 1 | 2 | 3 | 4 | 5 | 6 | 7 | 8 |
|---|---|---|---|---|---|---|---|---|---|---|---|---|---|---|---|---|---|---|---|---|---|---|---|---|---|---|---|---|---|---|---|---|---|---|---|---|---|---|---|---|
| VALUE | 3 | 8 | 1 | 6 | 7 | 4 | 5 | 2 | 6 | 3 | 4 | 1 | 2 | 7 | 8 | 5 | 1 | 6 | 7 | 4 | 5 | 2 | 3 | 8 | 4 | 1 | 2 | 7 | 8 | 5 | 6 | 3 | 7 | 4 | 5 | 2 | 3 | 8 | 1 | 6 |

TABLE №1 2 3 4 5 6

CON'T

| | | | | | | | |
|---|---|---|---|---|---|---|---|
| | 1 | 2 | 3 | 4 | 5 | 6 | 7 | 8 |
| | 5 | 2 | 3 | 8 | 1 | 6 | 7 | 4 |

7

FIG. 4.

RAM

| | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 1 | 2 | 3 | 4 | 5 | | | | | 10 | | | | | | | | 15 | | | | | | | | | | | | | | | | 20 | | | | | | | |
| 5 | 5 | 6 | 5 | 8 | 5 | 8 | 4 | 2 | 5 | 2 | 3 | 8 | 4 | 8 | 5 | 2 | 3 | 8 | 3 | 0 | | | | | | | | | | | | | | | | | | | | |

FIG. 6.

POCKET-SIZE ELECTRONIC DEVICE FOR PLAYING CHESS

FIELD OF INVENTION

This invention relates to a pocket-size portable electronic device for playing chess problems and for use as a teaching device in gaining skill and experience in the art of chess.

BACKGROUND OF THE INVENTION

There is a long history of attempts to build machines to play chess. The first significant results were achieved with large permanently installed digital computers; however, to date no computer chess play has been developed which can approach the play of a chess grandmaster. Attempts to implement an electronic chess game for mass markets have followed two approaches. The first is so simplistic as to offer little challenge, while the second attempts to employ a relatively expensive micro-processor to cope with the astronomical number of combinations possible in open chess play. A technical distinction between the two approaches is that the simpler system does not employ decision branching, while the open play system needs virtually infinite branching to prove effective.

This invention provides a pocket-size portable electronic device which achieves a satisfactory balance between the above mentioned approaches by permitting a degree of branching which enables the user to solve chess problems in a novel and challenging manner on a convenient and inexpensive electronic hardware implementation.

BRIEF SUMMARY OF THE INVENTION

The pocket-size portable electronic device is designed for use by a person playing one of the large numbers of orthodox or heterodox chess problems of the type which either have, or can be forced to have, unique definitive solutions within a determined number of white and black moves, on a conventional chess board. The electronic device comprises an electronic visual display, a display driver, an 8 digit keyboard and scanner, function keys and scanner, a random access memory, registers and counters, and a logic control unit which includes a switchable data bus controlled by a read only memory (ROM), a ROM pointer and a clock. A power supply integral to the unit provides power for the electronics.

The step by step, white and black moves which comprise the solution to the chess problem are loaded into the device via the key board, by entering sequentially, groups of coded numeric data. The logic control unit decodes these coded groups according to a special decoding algorithm which assures error-free loading and maintains the secrecy of the problem solution. The decoded groups of data are stored in the random access memory in the unique sequence of white and black moves which comprise the single optimum solution for the chess problem. In use the device will respond to specific white move inputs entered by the user. The device will produce a reject symbol if any input white move is not the same as the stored corresponding white move. If the white move is the same the device will display the next black move. The user then decides upon his next white move. There is a unique series of white moves that will correctly solve the problem and any attempts to enter erroneous white moves will be rejected. It is this inter-action with the user which provides novel and challenging play for both the experienced and inexperienced chess player in improving and exercising their skill in chess.

DESCRIPTION OF THE DRAWINGS

The above mentioned and other features and advantages of the invention will become apparent in the following detailed description of a preferred embodiment of the invention as exemplified in the drawings wherein:

FIG. 2 is a flow chart setting out in the broadest general sense the device's interaction and response to user input;

Figure 1:
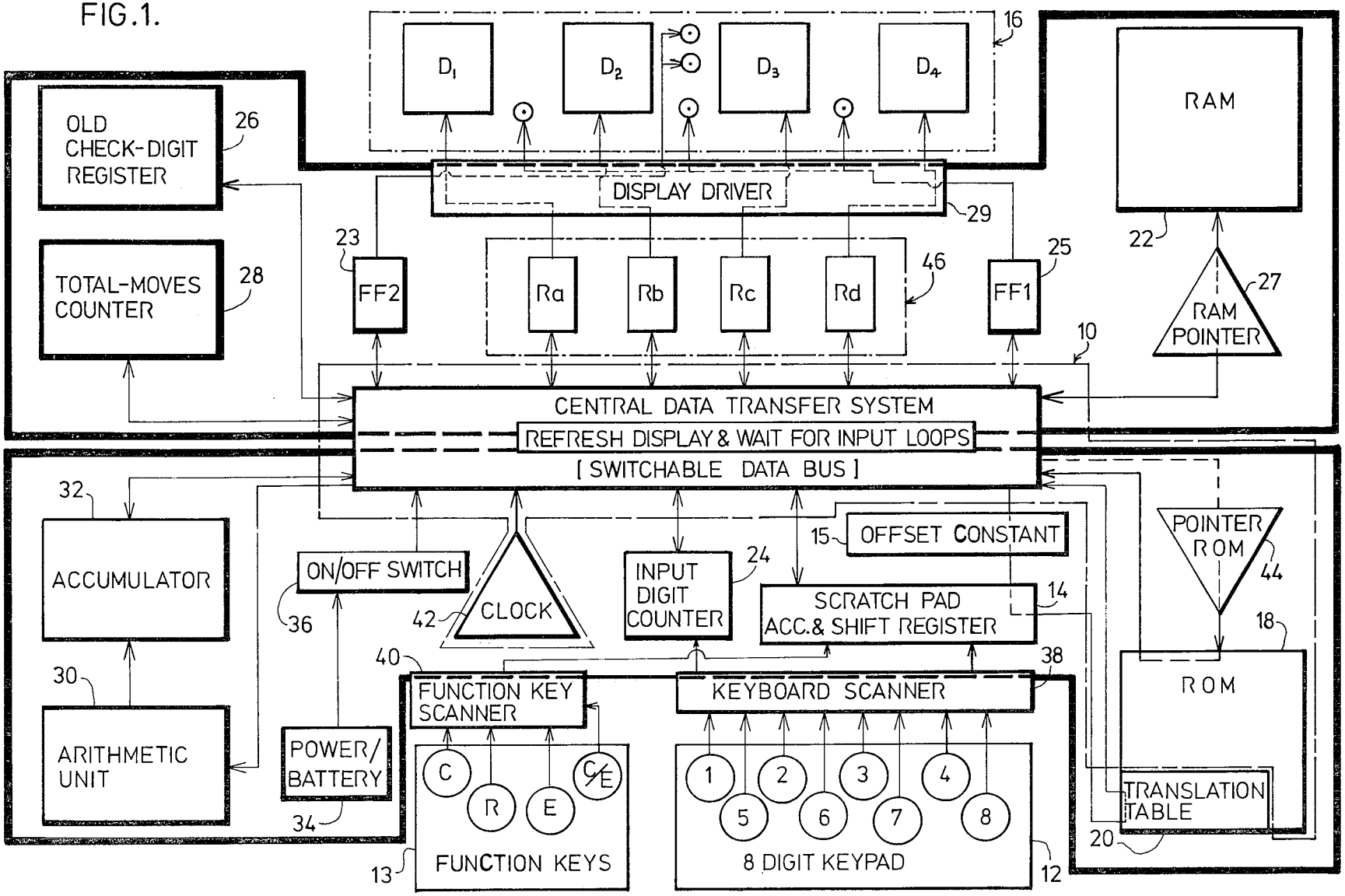
FIG. 1 is a representative block diagram of the electronic components of the device according to this invention.

FIG. *3a* - *3b* is a flow chart setting out the interrelationship of the device's components shown in FIG. 1 and the device's interaction with the user as shown in FIG. 2;

FIG. 4 is an example translation table map for the read only memory for use in coding and decoding input data for the device;

FIG. 5 which appears with FIG. 2, shows a chess problem used as an example in explaining the operation of the device;

FIG. 6 is a map of the storage in the random access memory of the white and black moves for the example problem.

DETAILED DESCRIPTION OF THE PREFERRED EMBODIMENTS OF THE INVENTION

FIG. 1 shows the lay-out of the electronic device in block form. The device is comprised of a logic control unit 10 shown in dashed line which controls the functions of the various components surrounding it. The key board part 12 having digits one to eight which provides for the input of digital information into the device via the keyboard scanner part 38 and the scratch pad 14, keyboard part 13 having four function keys defined as "E"enter, "C/E" clear/entry, "R" restart play and "C" counter (display) which input through the function key scanner part 38. Digital input to the device is displayed on the display 16 shown in dotted outline in locatins D1, D2, D3, and D4 as information is passed thereto through Single Digit Display Storage registers R*a*, R*b*, R*c*, and R*d*, also shown in dotted outline 46, and the Display Driver 29. The function keys cause action but are not displayed. The read-only memory 18, at times determined by the clock 42 and from locations indicated by the ROM pointer 44, — ROM — provides the program for the logic control unit 10 in; controlling the functions of the various components; the transfer of data between registers; and in detecting various flag conditions. The ROM 18 includes a translation table 20 for decoding the problem input for storage in the random access memory 22 — RAM — at locations determined by the RAM Pointer — 27. On the display 16 in addition to displays D1, D2, D3, and D4 there is located between displays D2 and D3 a symbol which is controlled by flip flop 23 — FF2 — and when this appears on the display it indicates to the user that the displayed data is the player's input. Located between display D1–D2, D2–D3, and D3–D4 are decimals, the display of which are controlled by flip flop 25 — FF1. When the decimals appear on the display it indicates to the user that the device has been correctly loaded and is ready to play the chess problem. Other components include an Input-Digit-Counter 24, an Old-Check-Digit Register 26, Total-Moves-Counter 28, and an arithmetic unit 30 with accumulator 32. The device is powered by a portable power supply 34, with an "on"—"off" switch 36.

It is this combination of components that provides an inexpensive electronic device for playing chess problems with a definitive solution within a determined number of white and black moves which provides for the novel and challenging play. As can be appreciated by those skilled in the art, either a custom device or one reconfigured from microprocessors or calculator components, according to this invention, the operation and design of which will be described in more detail, permits the manufacture of an inexpensive and economically feasible device for playing chess problems. The device's functions could, of course, be accomplished by use of a general purpose computer or relatively more expensive off-the-shelf micro-processors but it is the unique design of this invention as in the example described herein that provides a chess playing game practical for a mass market.

In order to better understand the operation and interrelationship of the components of the device, the flow chart of FIG. 2 sets out in general terms the device's operation. As discussed the electronic device must be capable of receiving sequential entry of coded information, decoding and verifying the correctness of the entered information, and storing the decoded information in a random access memory according to a particular sequence (of entry) so that the device can interact with the user to indicate when a correct white move has been made, and respond with the next black move required to achieve the problem solution. There are two distinct but associated modes of operation of the device. The modes will be referred to as the "load" mode and the "play" mode.

In the "load" mode coded groups of four digit numbers similar to the list entitled "Problem Code" in FIG. 5 are entered by the user into the system by means of the keyboard. Four digits are required to represent in coded form the initial position of a piece on the chess board and an additional four digits to represent in coded form the position to which the same piece is being moved. Twice the minimum number of digits is therefore required to describe the co-ordinates of the piece positions than are used during play. This is done to facilitate a degree of encoding and scrambling which conceals from the user the solution which he is entering into the device's memory and also permits a decoding algorithm to be used to detect incorrect entries.

In the "play mode" the user endeavours to solve a problem posed by an illustration of a chessboard with piece positions such as that shown in FIG. 5. His goal is to enter into the device by means of the keyboard moves for the pieces in such a manner that he will succeed in achieving a required state or condition in a designated number of moves (for example white to move and mate in three moves). Play proceeds in the following manner. First the player keys in four digits corresponding to the initial and terminal positions of the first white piece he intends to move. The device accepts these four digits, compares them with four digits which have been previously stored in the random access memory by decoding the entered 8 digits which correspond to the correct first white move. If the digits previously stored during the load mode and those just now entered by the player match, the device produces the black move and the player then responds with his counter white move. If, however, the player's first entry does not correspond to the first white move stored during the load operation, the device will inform the player by producing a visual signal (which in this example preferred implementation is a blinking display). The sequence of entries and responses continues until the player's final move achieves the problem solution at which time the device produces a signal indicating that the problem has been solved. The signal in this example preferred implementation is a display of the Total-Moves by white that have occured since the game was loaded.

The function of the electronic device according to this invention will be better understood from the following explanation of a representative orthodox chess problem. An essential consideration in designing or selecting a problem to be played on the device, is that the problem must either have, or be able to be forced to have a unique definitive solution within a predetermined number of white and black moves. As will be appreciated by those skilled in the art of chess, orthodox problems are played on conventional chess boards of 32 black and 32 white squares and follow the recognized convention for the movement of pieces.

All correctly formulated orthodox problems are expected to have no solution in less than the stated number of moves. However, some orthodox problems will permit the solution to be arrived at in different ways. That is there may be alternative moves that can achieve the desired result in the stated number of moves. The following problem is described to illustrate how some such problems can be forced to have a single definitive solution, the forcing being determined by the sequence of black moves which thereby determine the only correct and acceptable sequence of white moves. Other details of the operation will also be clarified in the course of the description.

Turning to FIG. 5, a problem is shown where white is to mate in three moves. There are four pieces on the board as follows:

| Square # | Piece |
|---|---|
| 85 | Black King |
| 55 | White King |
| 25 | White Rook |
| 11 | White Knight |

The square numbers, in this case, have been assigned on the basis of a modified version of the International Correspondence Chess Code. The first number of each square is determined by its row and the second number is determined by its column. The reverse convention is used in the International Correspondence Chess Code. In that system the first number for each square is determined by the column, and the second number by the row. Either system will work equally well on the device and problems coded either way may be used interchangeably on the same physical device.

The solution to the example problem follows: According to the recognized conventions, white moves first, and most importantly there is one and only one correct initial move for white, if white is to mate in three moves as required by the problem. The correct move for white in this case is 55:65. That is to say the white king is to move from square 55 on which it is initially residing to its terminal position for this move which is square 65.

The final solution to this problem may occur in one of two ways depending upon black's response. Black may move to either square 86 or to square 84. There are therefore two possible moves for black according to the recognized conventions. This means that, it might appear that there is not a unique solution to the problem. However, the choice of the square to which black is to move lies with the problem implementer, and the way he chooses to implement the problem will force white to make a unique and specific response in order to achieve the required goal of a mate in three moves.

For example if the black king moves to 86 then white must, or is forced, to move the rook from 25 to 27 in order to achieve the goal of mating in three. Given the stated black move there is no other possible way for white to achieve the goal of a mate in three. On the other hand if black moves from 85 to 84 then white must, or is forced, to move the white rook from 25 to 23 if he is to mate in three, as once again no other move will then achieve that goal.

The two complete possible series are as follows:

| Color | Move |
|---|---|
| White | 55:65 |
| Black | 8586 |
| White | 25:27 |
| Black | 8685 |
| White | 27:87 and MATE |

Alternatively:

| | |
|---|---|
| White | 55:65 |
| Black | 8584 |
| White | 25:23 |
| Black | 8485 |
| White | 23:83 and MATE. |

There are therefore two possible solutions to the problem, but the choice of the solution which will actually occur lies with black and this is what is meant by "forcing" a unique definitive solution within a determined number of steps.

Before describing how the information is coded and implemented on the device, it should be noted that the convention of showing white moves with a double dot (colon) such as in 55:65, is for the purpose of distinguishing them from the black moves which are obversely distinguished by showing them without a colon, such as in the 8586. In the described example implementation when the unit is ready to play a dot (period or decimal) appears between each digit as controlled by flip flop (FF1) so that moves can be distinguished from load mode code information.

The second series above will be used as an example in describing the operation of the device and would therefore actually appear on the device display during play as follows:

5.5 : 6.5
8.5.8.4
2.5 : 2.3
8.4.8.5
2.3 : 8.3
0.0.0.3

The last group of four numbers is the end of play indicator, which in this case indicates that a mate has been achieved and that only three white moves have been taken since the problem was loaded. The above series of four digit numbers represents what would sequentially appear on the display during play using the minimal number of entries possible in solving the described problem one time after it has been loaded.

When the problem is loaded into the device it is coded in such a manner as to maintain secrecy of the problem's solution. Otherwise, as is apparent, the user might remember the solution to the problem before he started, thereby rendering the device useless.

The following is a preferred method of coding for use with the electronic device. The example problem moves are broken down into two digit groups as follows. Their order is exactly determined by the above 4-digit groups.

55
65
85
84
25
23
84
85
23
83

The last series of four digits which were shown previously (0.0.0.3) were generated by the device during play and are not a part of the coding. The next step for the implementer, in coding this problem, is to randomly select numbers from the digits between 1 and 7 inclusive and attach them to the front of each of the above two digit series. For example, a random selection might be as follows:

2, 3, 6, 7, 4, 2, 1, 4, 6, and 5.

These numbers will select the translation tables and their use will be explained later in relation to FIG. 4. The random numbers are appended onto the former series in the above order given, to produce the sequence:

255
365
685
784
425
223
184
485
623
583.

The uncoded two co-ordinate digits in the above series of three digit numbers are converted to coded digits. This is done by using the map of the ROM translation table shown in FIG. 4. Beginning with the first number (255), the 2 which was randomly selected is the key to table 2. Looking along to position 5 in Table 2, it's value is found to be 2. Therefore the first digit 5 is translated to 2. The second digit is also 5 and therefore since the same table is being used, it will also translate to 2. Therefore the number (255) becomes 222.

The next number (365) is coded by use of table 3 because the first digit is 3. Once again looking at the same chart, in table 3, position 6 has a value of 2 and position 5 a value of 5, therefore the number 365 is translated to 325. This procedure continues until all the numbers are translated into code to produce the following sequence:

| Uncoded | Coded |
|---|---|
| 255 | 222 |
| 365 | 325 |
| 685 | 616 |
| 784 | 748 |
| 425 | 418 |
| 223 | 234 |
| 184 | 126 |
| 485 | 438 |
| 623 | 678 |
| 583 | 565 |
| 8171 | 8171 |

The final four digit number on the end of the above series was obtained by adding together the last digit in each of the above three digit series. This number will be used by the device as a final check that all the problem code has been correctly entered into the device. Therefore 2+5+6+8+8+4+6+8+8+5 equals 60.

An arithmetic algorithm referred to as "Crazy-8" is used to add the constant 111 to the number just obtained. Crazy-8 resembles Modulo-8, except there are no zeros because there are no zeros on the device's keyboard. The 111 is added because the system does not permit the entry of leading blanks.

Examples follow of how Crazy-8 addition works, since it is relevant to the described preferred implementation of the device. If 111 were added to 88 the answer would be 221. However, in the example being used 60 added to 111 gives 171 and this number is therefore attached to a leading 8 making it 8171 and this four digit number as seen above is used as the last entry line in the problem code. Incidentally this line of code has no relationship to the four digit group (0.0.0.3) on the end of the display series discussed earlier.

There is a final step that must be taken before the encoding is complete. It consists of the affixing of a check digit to each of the groups of numbers with three digits, so as to convert them into four digit groups with an error detecting capability. The algorithm for creating "check digits" is as follows: The old check digit, plus the table indicator digit, minus the first encoded move co-ordinate digit, plus the second encoded move co-ordinate digit, minus eight if the result is greater than eight, and minus eight again if the result is still greater than eight.

Beginning with the first coded group, since there is no "old" (or previous) check digit in this first instance, the value of the old check digit is zero. To this is added the value of the table indicator digit, which is two, and this gives a sum of 2. From this sum, there is subtracted the first encoded move co-ordinate digit which is also 2, giving zero, and finally there is added the second encoded move co-ordinate digit which gives a total of 2. This becomes the first check digit. It also becomes the "old" check digit for the next group and so is added to the next groups table indicator digit, which is 3, making a total of 5, which then has subtracted from it, the first encoded move co-ordinate digit which is 2, leaving a total of 3, and adding the second encoded move co-ordinate digit which is 5 giving a check digit of 8. The first two numbers have become 2222 and 3258 respectively. Continuing this procedure for the remaining coded digits, the following series is produced:

| Coded Group | Fully Encoded with Check Digit |
|---|---|
| 222 | 2222 |

-continued

| Coded Group | Fully Encoded with Check Digit |
|---|---|
| 325 | 3258 |
| 616 | 6163 |
| 748 | 7486 |
| 418 | 4181 |
| 234 | 2344 |
| 126 | 1261 |
| 438 | 4382 |
| 678 | 6781 |
| 565 | 5655 |
| 8171 | 8171 |

If the implementer objects aesthetically to the encoded list of digits, or otherwise he finds it undesirable, he may modify it by altering the table indicator digit selections. He should exercise care so that the process does not result in negative numbers which might produce an undefined and hence ambiguous condition in the hardware implementation.

Before proceeding with describing the function of the device during its use by the player, it should be mentioned that the coded groups to be loaded are related to the number of moves in the problem. Longer games will have more and shorter games fewer coded groups to be entered. However, there is absolutely no relation between the amount of code entered and the number of pieces on the board. In the example given, the knight, since it does not move has no effect upon the code. While it is not essential to the solution, and the purist might object to its appearance on the board, even if it were essential to the solution, it would not affect the amount of code if it did not move. Therefore a three move problem with twenty pieces on the board will require only the same amount of code as a three move problem with four pieces on the board. This makes it as easy to enter complicated problems as well as simple ones because the number and identity of the pieces in no way affects the code.

Figure 3A:
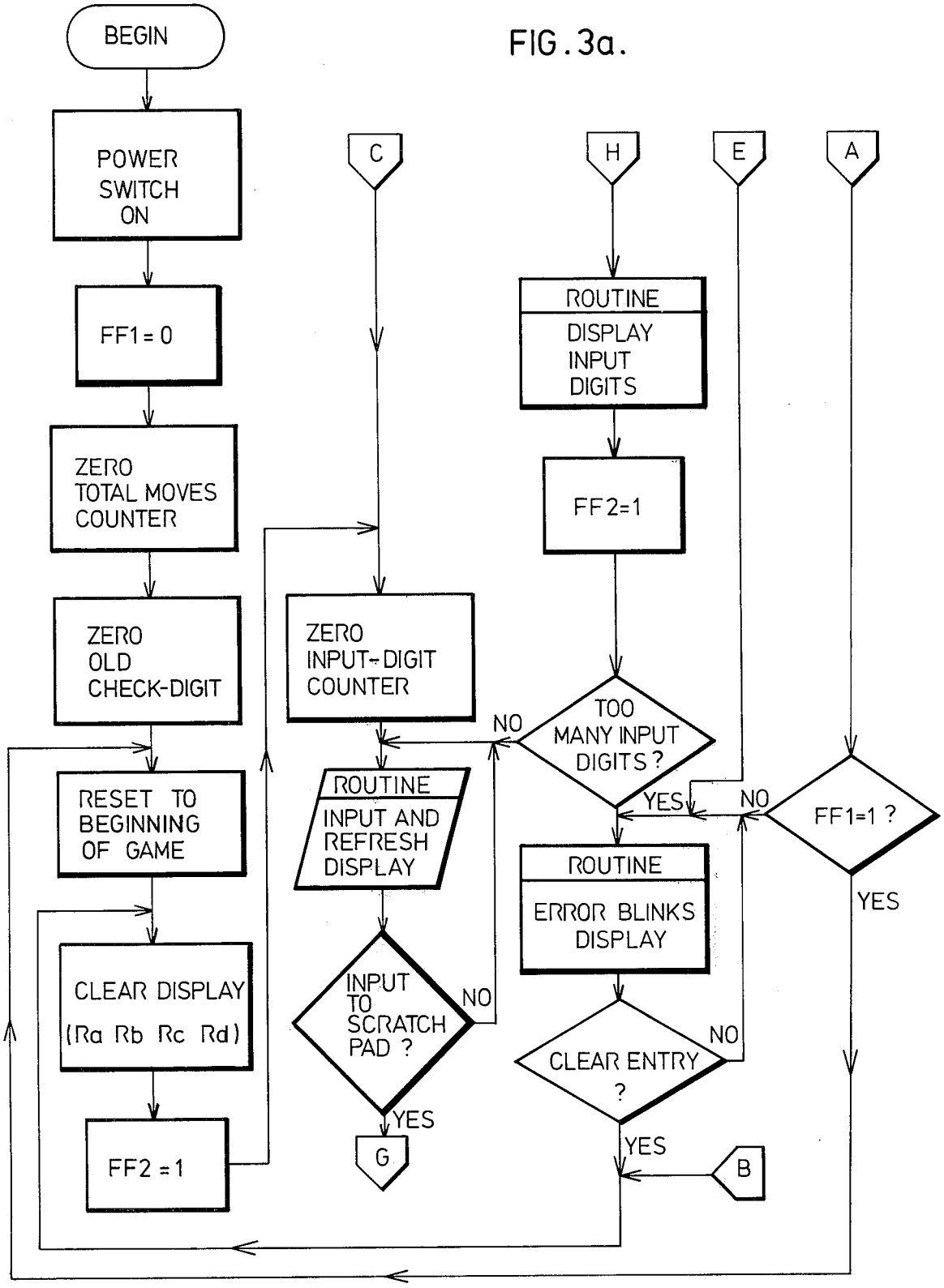
Figure 3B:
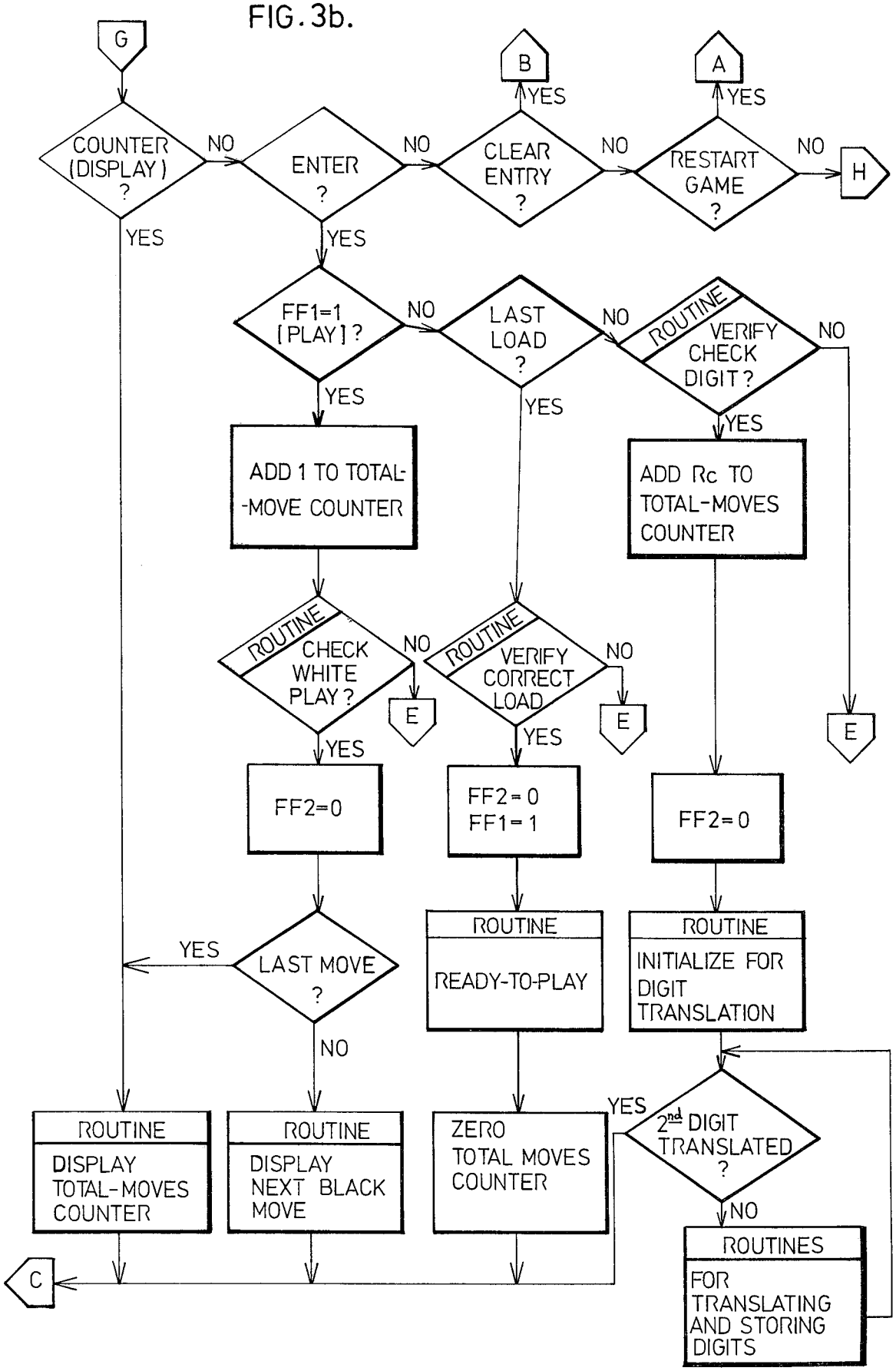

The operation of the device shown in FIG. 1 will now be discussed with reference to the flow chart of FIGS. 3*a* - 3*b*. The device is activated by turning power switch 36 "on." This in turn zeros the Ready-to-Play flag (FF1). Simultaneously the following registers and counters are initialized to "zero" and "blank" conditions respectively: the Total-Moves Counter 28, the Old-Check-Digit Register 26, and the Random Access Memory (RAM) location pointer 27 is set to zero; and the four single digit display storage registers (R*a*, R*b*, R*c*, R*d*) which control the electro-optical display are initialized to the blank condition. FF2, the "Player's-Entry-Flag" is set to "1" which causes a double dot (colon) to appear on the display between the 2nd and 3rd display digits. This prevents the display from being entirely blank in case it must be blinked, and at the same time indicates to the user that the power is on and that the device is awaiting an input. The "Input-Digit-Counter" 24 is set to zero and the input refresh display loop is entered. In this loop the four display storage registers are monitored by a Display Driver 29 and any change in their condition is communicated to the display. Although the monitoring process is periodic its frequency is sufficiently high so that it appears to be continuous. The keyboard 12 and the function key pad 13 are scanned by scanners 38 and 40 to detect the appearance of an input. The system is prepared to receive into its scratch pad any one of five different types of inputs from the keyboard 12 or function keypad 13 which are:

1) from the counter key, which causes the contents of the "Total-Moves Counter" to be displayed, 2) from the enter key which causes up to four digits which have been registered on the display by the user to be evaluated for either entry into RAM during load or for causing a display from the RAM during play as will be explained later, 3) from the clear entry key which causes the four single digit display storage registers to be set to blank and the display cleared. The FF2 flag is also reset to 1 so that the double dot will appear and the user will know that the device is again waiting for input, 4) from the "Restart Game Key" which causes the Ready-to-Play Flag (FF1) to be checked and if it is in a "1" state the game is ready to play, and the RAM pointer is again set to zero; which is the beginning of the memory, and the display is again cleared except for the Player-Entry-Flag, and the Input-Digit-Counter is zeroed so that the refresh display and wait for input routine may again be entered. Should the Ready-to-Play Flag (FF1) not be set to "1" and is therefore still "0" then the device will proceed with the error routine which will cause the display to blink until the clear-entry key is pushed, after which it will again proceed with the same steps described for when clear/entry is pressed;

5) If none of the above four function keys have been pressed then it is assumed that the entry is one of the digits 1 to 8 in which case the display input digits routine is entered and the Input-Digit-Counter is incremented by 1.

If this is the first user input since the Input-Digit Counter has been zeroed, any digits left over from a previous display of digits are removed, and the "Player's-Entry-Flag" is set to "1" causing the double dot to be displayed. Subsequent digit entries that are made from the key board are also displayed until an intervening function key is pressed unless there is an attempt to enter more than four digits, in which case the error routine is again entered with the same results as previously described. The user after observing the Player's-Entry-Flag begins by entering the first line of problem code which in this case is 2222. As he enters each 2 it will be recognized as a digit input and will be stored successively in the Single Digit Display Storage Registers R*a*, R*b*, R*c*, R*d*, and displayed in the display positions D1, D2, D3, and D4. After entering the fourth "2" the user pushes the "enter" key the device will examine the Ready-to-Play Flag to determine whether it is in a play mode or load mode. If FF1 is not equal to "1" then the device is in load mode. The examination of the entered group of coded data is begun by considering the value of the first input digit which is stored in R*a* to see if it equals 8. The only time that 8 is used as a translation table indicator digit is on the last entry for load. There is no number 8 translation table, and so an 8 indicates to the device that the last problem code entry has been made. What happens when the table indicator digit is equal to 8 will be discussed later. However, this is the first entry, so the table indicator digit is not equal to 8 and the device proceeds to verify the check digit. In order to do this it employs the algorithm described earlier for developing the check digit. Since the check digit was developed using this algorithm, the internally developed check digit and the check digit that has been entered into the single digit storage register R*d* will agree if the correct data has been entered. If the check digits do not agree, the device proceeds with the error routine previously described. An example of a condition that would cause the check digit to disagree occurs when the user has entered one of the four digit problem code lines in an incorrect sequence. This will always cause an error if the problem implementer has taken care to assure that no "old" and "new" check digit sequence ever repeats itself in the problem statement. Another cause of error could be that the user had entered an incorrect digit in this particular coded group of digits. Any incorrect digit or transposition of digits of other than the 1st and 3rd digits will cause the immediate entry into the error routine and permit immediate correction. The transposition of the first and third digits is possible because they are assigned the same algorithmic operator function. However, these are the least likely to be transposed. Even the transposition of the first and third digits will eventually be detected as all of the third digits are, as previously described, added together and their total value stored for a final check as will be described later. The combination of interlaced check digits that prevents the omitting of, or reordering of, the lines of code, and the use of the check digit to prevent internal transposition or altering of digits, along with the final check to prevent the one transposition that is possible, makes it extremely improbable that the problem code will be incorrectly entered and remain undetected.

In any case, the first line of code in the example, that is being followed has been entered correctly and is therefore verified, so the device now sets the Player's-Entry-Flag to "0" indicating to the user the input data has been accepted, by causing the double dot to disappear from the display. The device then adds the value stored in the Single-Digit-Display Register "R*c*" to the Total-Moves-Counter for later use in verifying that a correct and complete load has been achieved. The device then begins to translate the first encoded move co-ordinate digit by locating the beginning of the correct translation table in its Read-Only-Memory (ROM). It does this by using an algorithm which multiplies the translation table indicator digit stored in the single digit display storage register "R*a*" by the quantity 8 and subtracting from that answer 8 plus the part —15— Table Offset Constant. The address resulting from this operation is maintained in the scratch pad.

Then by adding 1 to the address in the scratch pad and 1 to a loop counter that has been previously set to "0," the logic control unit repeatedly compares the value stored in the ROM at the address indicated by the scratch pad with that of the first encoded move digit which is stored in the Single Digit Display register "R*b*." When a positive comparison is made, the value of the loop counter is then stored in the next RAM location, indicated by the RAM location pointer which is location 1 as shown by the RAM map of FIG. 6. The RAM location pointer is then incremented by 1. This process is repeated for the second digit. The beginning of the translation table is again determined and stored in the scratchpad as previously described, the loop counter is again set to zero and the loop counter and scratchpad are again repeatedly incremented by 1 until a positive comparison results between the value of the second encoded move digit which is stored in the Single Digit Display Register "R*d*" and the value stored in the ROM at the address indicated by the scratchpad. Then the value of the loop counter is again stored in the next RAM location and the RAM location pointer is once again incremented. The device now once again zeroes the Input Digit Counter and continues to refresh the display and await an input. The process of translation described above is the inverse of the procedure followed by the problem implementer in encoding the move co-ordinates. The first two digits shown as stored in the RAM map of FIG. 6 represent the initial position or the first half of the first white move.

Since the double dot has now disappeared from the display the user should realize that the code 2222 presently showing on the display has been accepted by the device and he should enter the digits 3258 and press the enter key. As the first digit is entered the device will again clear the remaining digits and restore the double dot to indicate that this is the player's entry. The same process just described for entering the previous line of problem code is repeated when the enter key is pressed. It will be determined that this is a code entry and not a play entry and it will be determined that it is not the last entry because the Translation Table indicator digit is not an 8. The check digit will be verified to assure that the entry is correct, and if it is not the display will blink. If the entry is correct the value in the display storage register "R*c*" is again added to the Total-Moves-Counter, and the double dot Player's-Entry-Flag will be removed from the display. The two encoded digits will be translated and stored in the next RAM locations as shown in FIG. 6 and the RAM location pointer will be incremented and the Input-Digit-Counter will be reset to zero so the device can once again continue to refresh the display and await further input.

This process will continue as described for all the lines of code until the last line. So long as the code is correctly entered the double dot will disappear and if it is incorrectly entered the display will blink until the "*c/e*" clear-entry key is pressed. When the last line of code is entered the device will detect that it is the last load line because the single digit display storage register "R*a*" will contain an 8. The device will then use the following algorithm to translate the last input code into a base-ten value. The value stored in R*b* will be moved to the scratch pad and multiplied by 8, there will then be added to this intermediate result in the scratch pad the value stored in "R*c*," and this intermediate result will again be multiplied by 8. To this intermediate result in the scratch pad there will be added the value stored in "R*d*," and finally from this intermediate result in the scratch pad there will be subtracted the constant 73 (which is the base 10 equivalent of the Crazy-8 constant 111 previously used in forming the code. The final result in the scratch pad will now be compared to the total in the "Total-Moves-Counter" and if they are not equal the previously described error routine will be executed. If the user has correctly entered the last line and an error is indicated the user must turn the power "off" and "on" again and restart the whole loading routine. Assuming, that the load is successful the double dot Player's-Entry-Flag (FF2) will be set to zero and the double dot will disappear from the display, and the Ready-to-Play flag (FF1) will be set to one and there will appear on the display the three decimal dot Ready-to-Play Indicator. The Total-Moves-Counter will then be set to zero and a "0" will also be stored in the next RAM location as shown in FIG. 6.

Once the user sees the Ready-to-Play Flag he should realize that the device is ready to play. In order to begin play he must press the "R" Restart-Play key. The device will then determine the Ready-to-Play-Flag is set at 1 and reset the RAM Location Pointer to zero which is the beginning of the first word of memory, and clear the display, except for the Ready-to-Play-Flag and the Player's-Entry-Flag, and then continue to refresh the display and await an input.

The player now begins to enter what he believes is the problem solution. As each digit is entered it is displayed as before. Once the player has entered four digits and pressed the "E" Enter key the device determines that it is in a play mode because the Ready-to-Play Flag (FF1) is in the "1" state. The number 1 will be added to the Total-Moves-Counter to keep track of both successful and unsuccessful move attempts of the problem solver. Each of the input digits R*a*, R*b*, R*c*, and R*d*, are compared in turn with the respective four values stored in next four RAM locations. If any one of them is not the same the device enters the error routine, blinks the display, waits for the "*c/e*" key to be pressed and then resets the "Input Digit Counter," continues to refresh the display and await new input. If the input does compare with that stored in the RAM then the RAM location pointer is incremented by 4 and the Player's-Entry-Flag (FF2) is set to zero so that the double dot disappears from the display. If the next RAM location contains a zero as shown in FIG. 6 this indicates that the game's objective has been achieved and the device then displays the Total-Moves-Counter. If the next RAM location does not contain a zero then the next four RAM locations containing the next black move are moved to R*a*, R*b*, R*c*, and R*d*, and displayed. Once the black move has been displayed the "Input Digit Counter" is again zeroed and the device continues to refresh the display and await input. In this manner interaction between the user and the device continue until the user completes the game and turns the power off. The user has the option of pushing the Restart Game Key at anytime and the device will then again expect the first white move. The Total-Moves-Counter continues to increment, however, no matter how many times the Restart Game key is pushed.

If a number of individuals wish to solve the same problem competitively after it has been loaded, they may determine how many moves have been previously made by looking at the Total-Move-Counter before they begin and may then determine the difference on the counter when they are finished. The Total Moves Counter may be inspected at any time during play. The Total-Moves-Counter will be reset to zero only once during a power on, however, and that is at the end of a correct load. To reset the Total-Moves Counter, therefore, the player must turn the machine "off" and again "on" and reload the program.

After display of the black move, the user then assesses the problem and enters four digits indicating the coordinants of the next white move. This group of digits is compared to the next four RAM locations and if the comparison is positive, the device displays the next black move. This procedure continues until the final white move has been made to mate black. In this example the final white move would be the entry of digits 2.3 : 8.3.

The device according to this invention therefore provides a chess game player with a relatively inexpensive device which incorporates an interactive response to the player's attempts to produce a defined sequence of moves which will result in the required terminal board configuration. It notifies the player when an incorrect move has been made, and responds with a counter move if the correct move has been made. The device does not incorporate either a strategy or any logical deductive powers, yet it responds intelligently to a player's moves. Thus it provides a novel challenging game and teaching device which can be of benefit and amusement to the novice and the sophisticated chess player alike.

Although various preferred embodiments of the invention have been discussed herein in detail, it will be understood by those skilled in the art, that operative variations maybe made thereto without departing from the spirit of the invention or the scope of the appended claims.

The embodiments of an invention in which an exclusive property or privilege is claimed are defined as follows:

1. A pocket-size portable electronic device for playing chess problems of the type which have a unique definitive solution within a determined number of white and black moves, said electronic device comprising an electronic visual display, a display driver, an 8-digit keyboard and scanner, function keys and scanner, a random access memory, registers and counters, and a logic control unit which includes a switchable data bus controlled by a read only memory, a read only memory pointer and a clock, said device displaying sequentially in digital form the black moves in opposition to the respective sequential entry of correct white moves, said read only memory by way of said logic control unit controlling the sequence of functions of said device in both a load mode and a play mode; in the load mode of said device, coded groups of data are supplied through said keyboard, which are decoded under the control of said read only memory according to an algorithm, and sequentially stored in said random access memory, the decoded groups of digits signifying the white and black moves in solving the chess problem and the sequence in which they are stored in said random access memory determining sequentially the white and black moves for the single solution, said logic control unit causing display of an indication when there is an incorrect entry of a coded group of digits when the conditions of the algorithm are unsatisfied; in the play mode, a group of digits indicating a user's attempted white move are entered through said keyboard, such group of digits having the same number of digits as the number in said stored decoded group of digits corresponding to the correct white move in the sequence, said logic control unit on a positive comparison directing the display of the next group of decoded digits in the random access memory signifying the next black move and said logic control unit on a negative comparison causing the display of an indication of an incorrect white move, said logic control unit continuing the comparison of entered white moves with corresponding stored white moves until all of the black moves have been displayed at which point an end of game is displayed.

2. A method of playing chess problems with a pocket-size portable electronic device, such chess problems having a unique definitive solution within a determined number of white and black moves, said electronic device comprising an electronic visual display, a display driver, an 8-digit keyboard and scanner, function keys and scanner, a random access memory, registers and counters, and a logic control unit which includes a switchable data bus controlled by a read only memory, — ROM —, a ROM pointer and a clock, said read only memory by way of said logic control unit controlling the sequence of computing functions of said device in both a load and a play mode, said method comprising entering a series of coded groups of digits through said keyboard, said logic control unit decoding said groups of digits according to an algorithm stored in said read only memory, the decoded group of digits representing the co-ordinates on a chess board of correct white and black moves, said algorithm determining if the coded groups of digits have been properly entered and, if improper, said logic control unit directing a visual indication of such fault; otherwise said logic control unit directing the storage in the random access memory of the decoded digits representing the correct white and black moves; said logic control unit being switched to the play mode upon correct entry of the last coded group of digits, whereon there is entered through said keyboard a group of digits representing the beginning and ending co-ordinates of a white move in an attempt by the user to solve the problem, said logic control unit comparing said first group of digits to the stored decoded group of digits which represent the correct first white move for solving the problem, said logic control unit on a positive comparison displaying the next stored decoded group of digits representing the first black move in opposition to said correct first white move; said logic control unit on a negative comparison only displaying an indication of an improper white move, said logic control unit continuing the comparison of entered white moves to the corresponding stored white moves until all black moves in the stored groups of digits have been displayed, at which point said logic control unit displays a play end.

* * * * *